United States Patent [19]

Pappas et al.

[11] 4,345,178

[45] Aug. 17, 1982

[54] HIGH INTENSITY REFLECTOR LAMP

[75] Inventors: John A. Pappas, Winthrop; Roger T. Hebert, Peabody, both of Mass.

[73] Assignee: GTE Products Corporation, Stamford, Conn.

[21] Appl. No.: 251,661

[22] Filed: Apr. 6, 1981

Related U.S. Application Data

[63] Continuation of Ser. No. 865,616, Dec. 29, 1977, abandoned.

[51] Int. Cl.[3] ..... H01J 61/35; H01J 61/36

[52] U.S. Cl. ..... 313/113; 313/25; 313/318

[58] Field of Search ..... 313/113, 318, 25; 339/144 R

[56] References Cited

U.S. PATENT DOCUMENTS

| | | | |
|---|---|---|---|
| 2,596,697 | 5/1952 | Krefft | 313/114 |
| 2,976,513 | 3/1961 | Sasserson | 339/144 R X |
| 3,250,939 | 5/1966 | Dayton et al. | 313/113 |
| 3,852,631 | 12/1974 | Evans | 313/113 X |

*Primary Examiner*—Palmer C. Demeo

*Attorney, Agent, or Firm*—Edward J. Coleman

[57] ABSTRACT

A reflector lamp comprises an arc discharge tube disposed at about the focus of a parabolic reflector. The arc tube is supported by two lead-in support wires which extend through the back of the reflector. The external ends of the lead-in support wires are secured in a stabilizer support which is adhesively bonded to the back of the reflector.

2 Claims, 3 Drawing Figures

HIGH INTENSITY REFLECTOR LAMP

This is a continuation of application Ser. No. 865,616, filed Dec. 29, 1977, and now abandoned.

This invention concerns a high intensity reflector lamp such as is used on commercial aircraft for landings at night. The lamp comprises an arc discharge tube mounted cross axially within the parabolic reflector of a sealed beam unit. The lead-in support wires for the arc tube extend through the reflector and are hermetically fastened to ferrules which are sealed to the glass reflector. The lead-in support wires extend externally beyond the ferrules and are clamped within a stabilizer support which is bonded to the reflector. The purpose of such a clamping arrangement is to stabilize the arc tube during vibration, because the lead-in support wires for the arc tube are relatively long and the resulting moment on the arc tube during vibration can be quite severe.

Figure 1:
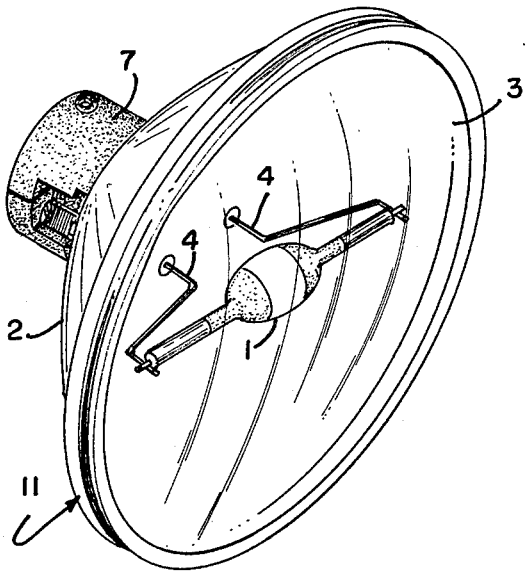
FIGS. 1 and 2 are perspective and side views, respectively, of a sealed beam lamp in accordance with this invention.
Figure 2:
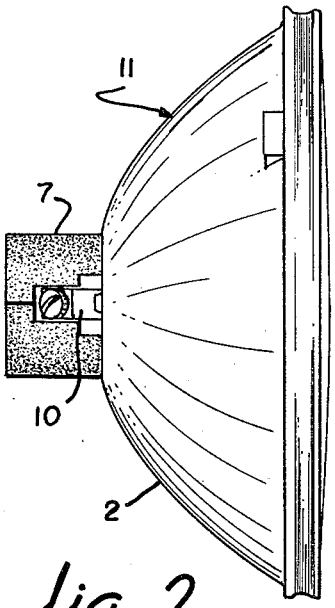
Figure 3:
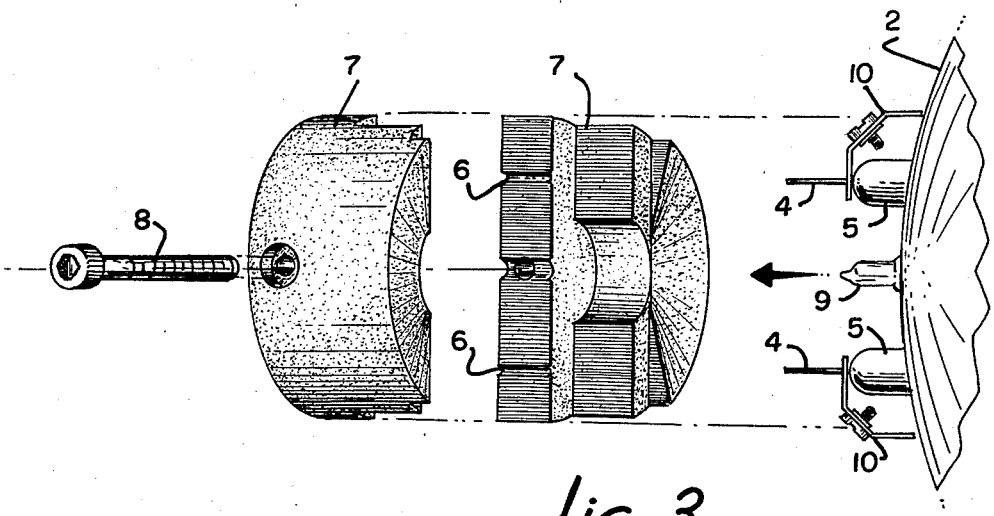
FIG. 3 is an expanded view showing the stabilizer support in more detail.

The lamp comprises, in one embodiment, a short arc discharge tube 1 of the type that requires a high voltage pulse for ignition and has a fill including argon, mercury and metal halide. The operating pressure of arc tube 1 is several atmospheres. In one example the distance between electrodes of arc tube 1 was 12 mm, the body was about 19 mm in diameter, and the overall length was 11 cm. Arc tube 1 is disposed within a hermetically sealed envelope 11 that consists of parabolic reflector 2 sealed to cover glass 3 and the body of arc tube 1 is located at about the focus of parabolic reflector 2. To minimize the possibility of high voltage arc-over, envelope 11 is filled with nitrogen at about one atmosphere of pressure.

Arc tube 1 is supported on two lead-in support wires 4, e.g., 125 mil molybdenum rods, which extend through and are hermetically sealed, e.g., by brazing, to metal ferrules 5 which are glass-to-metal sealed to the back of reflector 2. The external ends of wires 4 fit into holes or slots 6 of a two piece stabilizer support 7 made of ceramic or high temperature plastic and are supported or held therein when the two halves of stabilizer support 7 are clamped together by means of bolt 8 and when stabilizer support 7 is adhesively bonded to the back of reflector 2. Holes 6 have a slightly smaller diameter than that of lead-in support wires 4 to insure clamping. The bonded surface of stabilizer support 7 is contoured as reflector 2. The adhesive used is preferably flexible and can withstand temperatures of about 200° C.; an example of such an adhesive is room temperature curing silicone rubber. Stabilizer support 7 has cutouts to accommodate ferrules 5 and tipped off exhaust tube 9. Ferrules 5 have terminals 10 brazed thereto for the purpose of connection to an electric power source. Exhaust tube 9 is used to exhaust envelope 11 and fill it with nitrogen.

In one example, reflector 2 was a PAR 64 (8" diameter) and arc tube 1 operated at 575 watts, 95 volts. The lamp emitted 49,000 lumens and had a center beam candlepower of more than 1,000,000 in contrast, the prior art lamp, which consisted of a tungsten halogen lamp within a PAR 64 reflector, operated at 600 watts, 28 volts, but only emitted 18,000 lumens and had a center beam candlepower of only 600,000. The efficiency of the lamp as per this invention was about triple that of the prior art lamp and the life was at least 5 or 10 fold.

We claim:

1. A reflector lamp comprising: an arc discharge tube disposed at about the focus of a parabolic reflector and supported by two lead-in support wires extending through the reflector and sealed to, and extending through and beyond, two ferrules which are glass to metal sealed to the reflector; a stabilizer support adhesively bonded to the back of the reflector, the external ends of the lead-in support wires being directly secured in the stabilizer support in order to stabilize the arc tube during vibration.

2. The lamp of claim 1 wherein the stabilizer support comprises two halves and the external ends of the lead-in support wires are clamped within slots in said two halves.

* * * * *